US005816830A

United States Patent [19]

Griffith et al.

[11] Patent Number: 5,816,830

[45] Date of Patent: Oct. 6, 1998

[54] ELECTRICAL CONNECTOR MODULE FOR A HIGH DENSITY ELECTRICAL CONNECTOR

[75] Inventors: Gregory Gordon Griffith, Carlisle; Barbara Ann Adams, Palmyra; William Francis Foley, New Cumberland; William Edward McClusky, Harrisburg; David Francis Fleming, Palmyra; Scott Von Snyder, Glen Rock; Trevor Dale Alexander, Willow St., all of Pa.

[73] Assignee: The Whitaker Corporation, Wilmington, Del.

[21] Appl. No.: 703,765

[22] Filed: Aug. 27, 1996

Related U.S. Application Data

[60] Provisional application No. 60/006,576 Dec. 15, 1995.

[51] Int. Cl. [6] ..... H01R 9/09

[52] U.S. Cl. ..... 439/79

[58] Field of Search ..... 439/79, 80, 629, 439/630, 634, 636, 637, 631, 260

[56] References Cited

U.S. PATENT DOCUMENTS

| | | | |
|---|---|---|---|
| 3,634,814 | 1/1972 | Inacker | 439/634 |
| 4,639,056 | 1/1987 | Lindeman et al. | 439/631 |
| 4,659,155 | 4/1987 | Walkup et al. | 439/79 |
| 5,090,116 | 2/1992 | Henschen et al. | 29/827 |

FOREIGN PATENT DOCUMENTS

| | | | |
|---|---|---|---|
| 137972 | 4/1985 | European Pat. Off. | 439/634 |
| 1 484 730 | 9/1977 | United Kingdom | H05K 1/12 |

*Primary Examiner*—Gary F. Paumen
*Assistant Examiner*—Tho D. Ta
*Attorney, Agent, or Firm*—Salvatore Anatasi

[57] ABSTRACT

This invention relates to the field of high density connectors for connecting circuit board edges to other connectors. A modular design is provided which has modules that fit into a frame to form the connector. Each module consists of a housing having a base and a cover which receives the circuit card edge. The cover is designed to insulate between adjacent contacts and to maintain contact tail spacing. This cover also eliminates the need for additional potting material between contact tails and reduces the overall height of the connector.

12 Claims, 11 Drawing Sheets

ELECTRICAL CONNECTOR MODULE FOR A HIGH DENSITY ELECTRICAL CONNECTOR

This application claims the benefit of U.S. Provisional application No. 60/006,576, Filed Dec. 15, 1995.

FIELD OF THE INVENTION

The present invention relates to the field of electrical connectors and more particularly to connectors for electrical connection to circuit elements such as a printed circuit board.

BACKGROUND OF THE INVENTION

The military and the aircraft industry has moved toward a modular design for use in black boxes that record events during flight. Each of these black boxes contains a plurality of line replaceable modules (LRMs) that are all electrically connected to a mother board in the black box. Each LRM has a different function, for monitoring and recording particular types of events curing operation and each is individually removable when found to be defective A high density connector is typically one element in an LRM which also comprises a PC board such as a ceramic substrate mounted within a board mounting frame attached to the connector. The PC board may carry circuitry ranging from simple circuits to very sophisticated integrated circuits in order to perform the specific desired function of the particular LRM. Since miniaturization is desirable in avionics and military applications due to weight and space constrictions, the size of the connectors is becoming even smaller and the density of contacts is typically very high. These connectors, however, can be used in any application where space is at a premium and high contact density is required.

Removable line replaceable modules (LRMs) are an important time saving mechanism when a single component fails. For instance, in military applications, rather than replacing an entire black box, a single LRM containing the defective element may be replaced. The high density connectors easily disconnect from their mother board connectors and allow each LRM to be easily removed from the black box. The use of this principal of exchanging standard LRMs instead of complete boxes has decreased aircraft down time and allowed interchangeability of LRMs in different aircrafts.

U.S. Pat. No. 4,639,056 discloses a connector having contacts disposed in a housing with terminal portions and tail portions The tail portions contact pads on the circuit board and the terminal portions connect to a mateable connector. The circuit board fits into a cover which is disposed over contact tails as they are bent outwardly after protruding through the top of the housing. Between the cover and the contact tails, there is a potting material or a resin which embeds and insulates contacts from each other and maintains contact spacing while adding to the overall height of the connector. The potting material adds to the height of the connector, and it is desirable to reduce the overall height of the connector, maintain the level of insulation provided by the potting material, and increase the contact density.

U.S. Pat. No. 5,090,116 also discloses a connector for an LRM, where a circuit board is mounted directly over contacts in the connector. While this reference has no potting layer which resultantly decreases the overall height of the connector, the insulative properties of the potting material are lost. For example, the protection against debris, and the possibility of inadvertent engagement of a metal layer with the daughtercard contacts. In order to achieve the desirable higher density in these connectors, insulation is necessary between adjacent contacts.

A problem exists where it is desirable to minimize the overall connector height while maximizing contact density by increasing the number of rows of terminals which exit the bottom of the connector. Also, there is a need to increase the overall connector length so as to increase the total number of connections possible for each LRM and this creates an additional problem in that molding such a long connector housing is difficult because of inaccuracies that result in contact cavity shape and precision of placement due to post-molding shrinkage common in a long molded part.

SUMMARY OF THE INVENTION

It is therefore an object of this invention to provide a high density modular connector while minimizing the overall connector size.

It is a further object of this invention to provide such a connector which is easily and economically manufacturable, as well as easily assembled.

These objects of the invention were accomplished by providing an LRM connector comprising a series of modules each having an insulative housing comprising of a base and a cover, and, a plurality of contacts having terminal portions and tail portions disposed in passageways therein.

The module bases and covers interfit and are held securely within a common shielding frame to create a connector having continuous rows of tails which connect to respective pads on the circuit board. Because of the modularity of this LRM connector, longer connector lengths can be achieved. This is because the inherent problems, such as shrinkage, resulting in imprecisely located and shaped contact cavities in a long high density molded plastic housing, are avoided by molding smaller modular pieces that interfit together. A higher degree of accuracy can thus be achieved in contact spacing and location. The slots on the top of each module cover must be precisely aligned to form one continuous slot for receiving a circuit board edge, and the base and cover are designed to permit such precise slot alignment prior to bonding of the cover to the base.

A feature of the present invention is that the cover may be placed directly over the tails exiting the base top, thus obviating the need for potting material and reducing the overall height of the connector while providing insulation between adjacent contacts by small projections in the base which cooperate with comb projections in the cover.

Another feature of the present invention is that the each of the covers is initially slidable incrementally in the lateral direction across the base. Once the bases are assembled within the frame with contacts loaded therein, each of the circuit board edge receiving slots on the top surfaces of the covers can be aligned to be co-linear so that a board will properly fit therein after which the covers are bonded to the bases.

Another feature of the present invention is that various connector lengths can be made by assembling a connector from a plurality of limited size modules thus using the same housing and cover molds for each module.

The embodiments of the present invention will now be described by way of example with reference to the accompanying drawings in which.

DETAILED DESCRIPTION OF THE INVENTION

Figure 1:
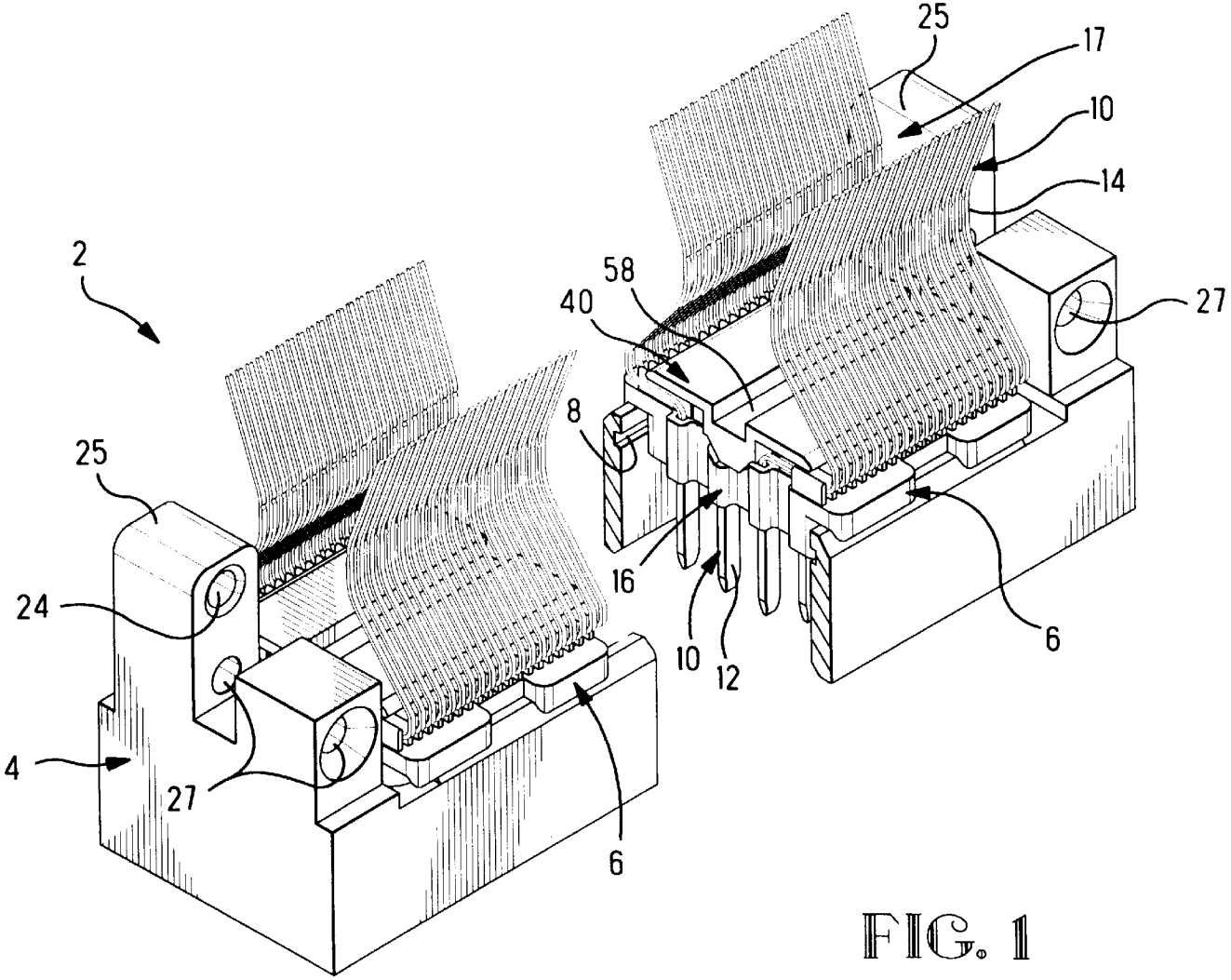
FIG. 1 shows an isometric view of a board-edge mountable connector showing two modules with the center section cut away.
Figure 2:
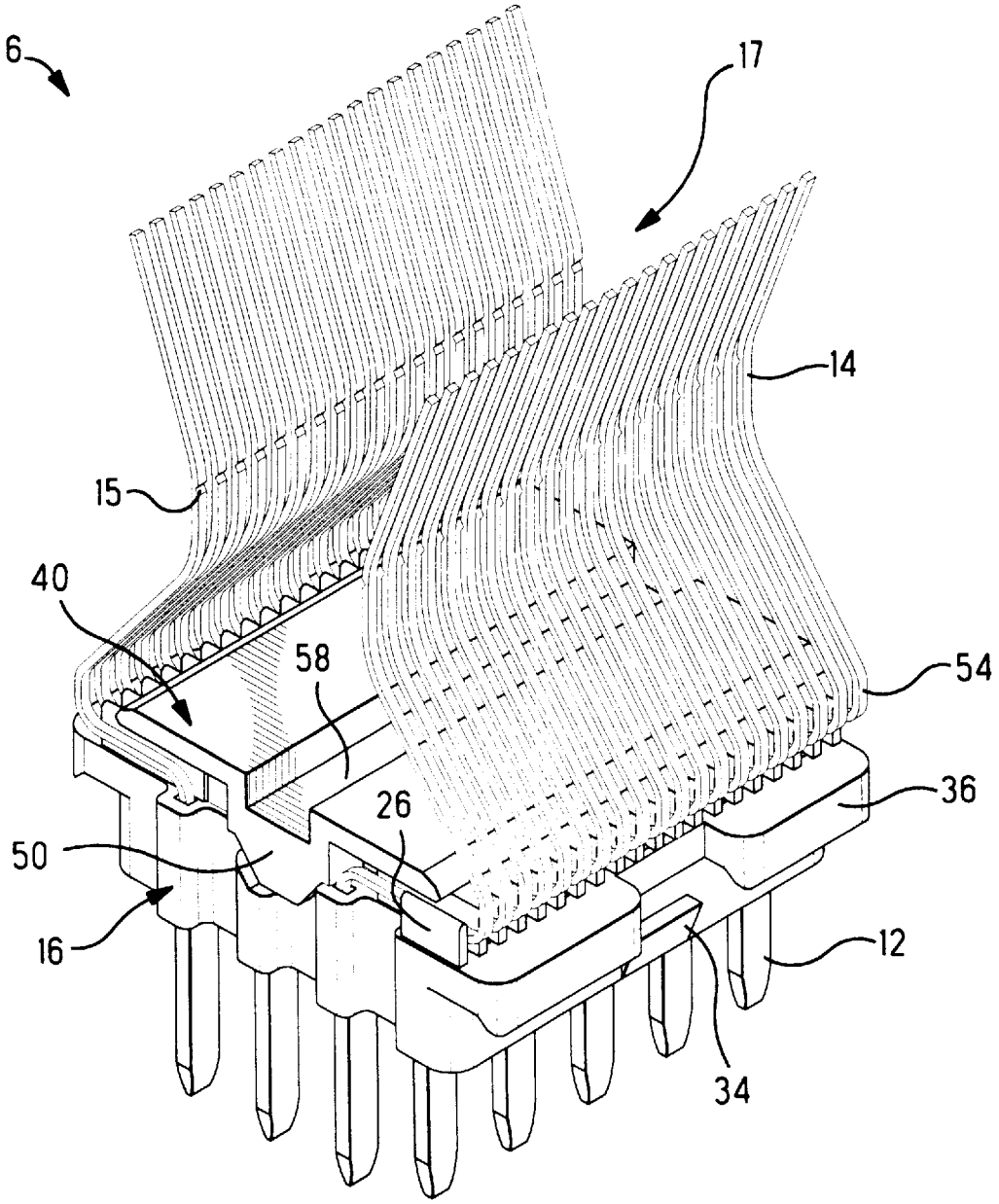
FIG. 2 shows a completed connector module comprised of a cover and a base module.

Referring to FIGS. 1 and 2, a connector assembly 2 is shown to include a rigid conductive frame 4 which is profiled to receive a plurality of electrical connector modules 6. Only the two end modules 6 are shown in FIG. 1 for simplicity. The modules 6 are latched into a groove 8 in the frame 4. They also cooperate with adjacent modules 6 to form continuous rows of contacts 10 having a plurality of rows of contact section 12 extending from the mating face of each module, and tail section 14 extending from a cover receiving face 20 (FIG. 9) to form a circuit board receiving opening 17. The assembly 2 is designed to terminate a circuit board (not shown) and mate to a mating connector. A circuit board edge is insertable through the circuit board receiving opening and into a slot 58 so that the printed circuit board contact pads (not shown) are aligned with respective contact tail section 14 of the assembly 2 after which the tail section 14 are soldered to the respective contact pads. Threaded holes 24 in maintaining flanges 25 at the opposite ends of the frame 4 receive screws or bolts that go through a circuit board edge (not shown) and secure the circuit board to the assembly 2. A protective shield cover (not shown) around the circuit board and its components may be secured to the assembly 2 using bolts which are received in threaded holes 27. Each of the major components will now be described in greater detail.

Figure 3:
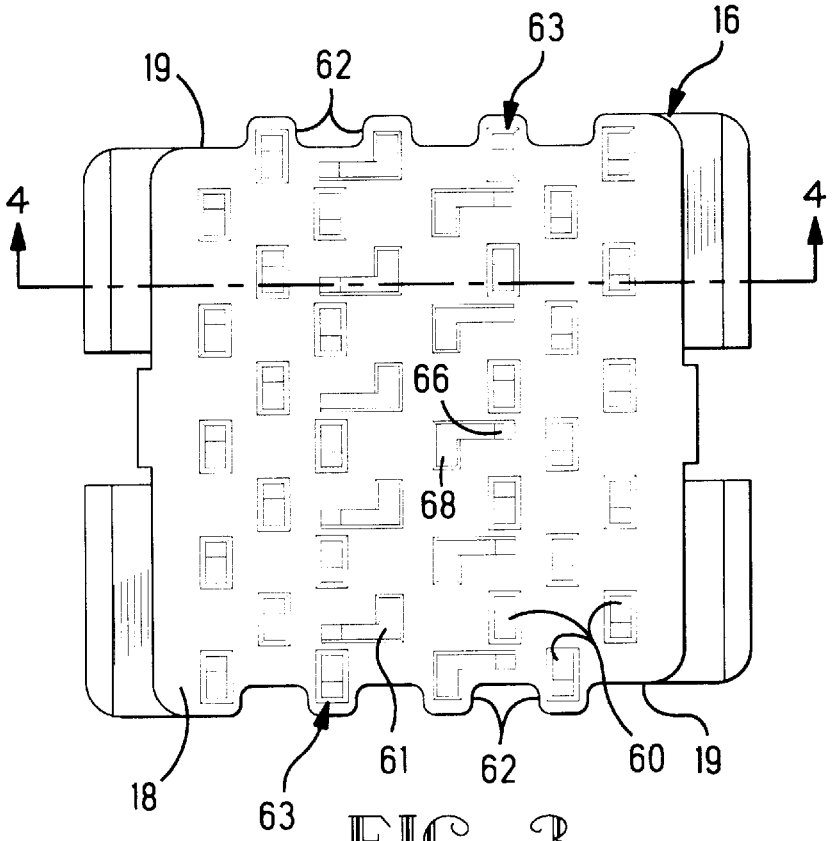
FIG. 3 shows a bottom view of the base of FIG. 2.

The base 16 will now be described in greater detail with reference to FIGS. 3 and 4. The base is made from a suitable dielectric material and has opposed ends 19 and two sides 21 and 23, a top surface or cover receiving face 20, and a bottom surface or mating face 18. Ends 19 contain projections 62 defining complementary projection-receiving recesses therebetween, and the projections are received in the complementary recesses of adjacent modules in the assembly 2. Referring now to FIG. 3, the mating face 18 of the base 16 is shown as having eight rows of contact receiving cavities 60, 61 symmetrically disposed about a center axis passing through ends 19. Only four rows of cavities will be described below due to the symmetry.

Beginning from the outermost row adjacent to either edge 21 or 23, three rows of cavities 60 are staggered with respect to each other and pass straight through the base 16. The fourth and innermost row has cavities 61 that are L-shaped and begin at a location equally distant from the center axis as the third row 63. A long leg 66 of the L-shaped cavity 61 then extends towards the center axis of the base 16 and a short leg 68 thereof is disposed against the center axis.

Figure 4:
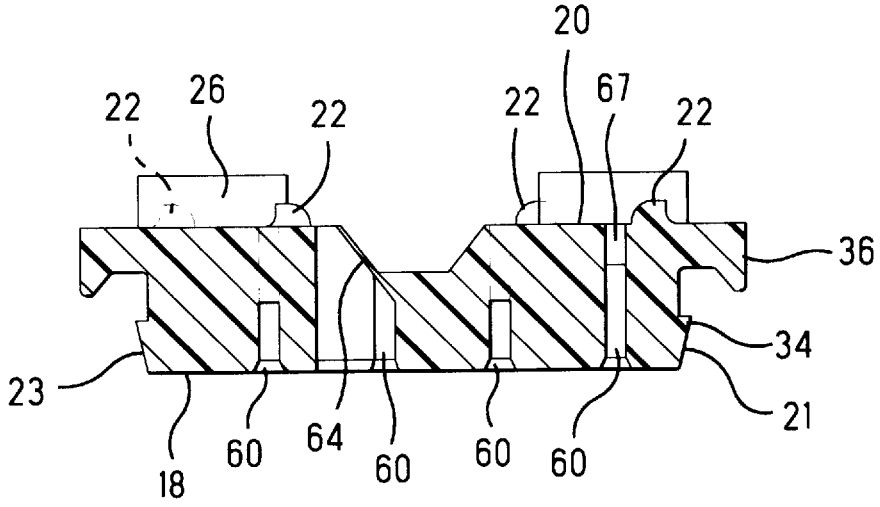
FIG. 4 is a cross-sectional view along line 4—4 of FIG. 3.
Figure 8:
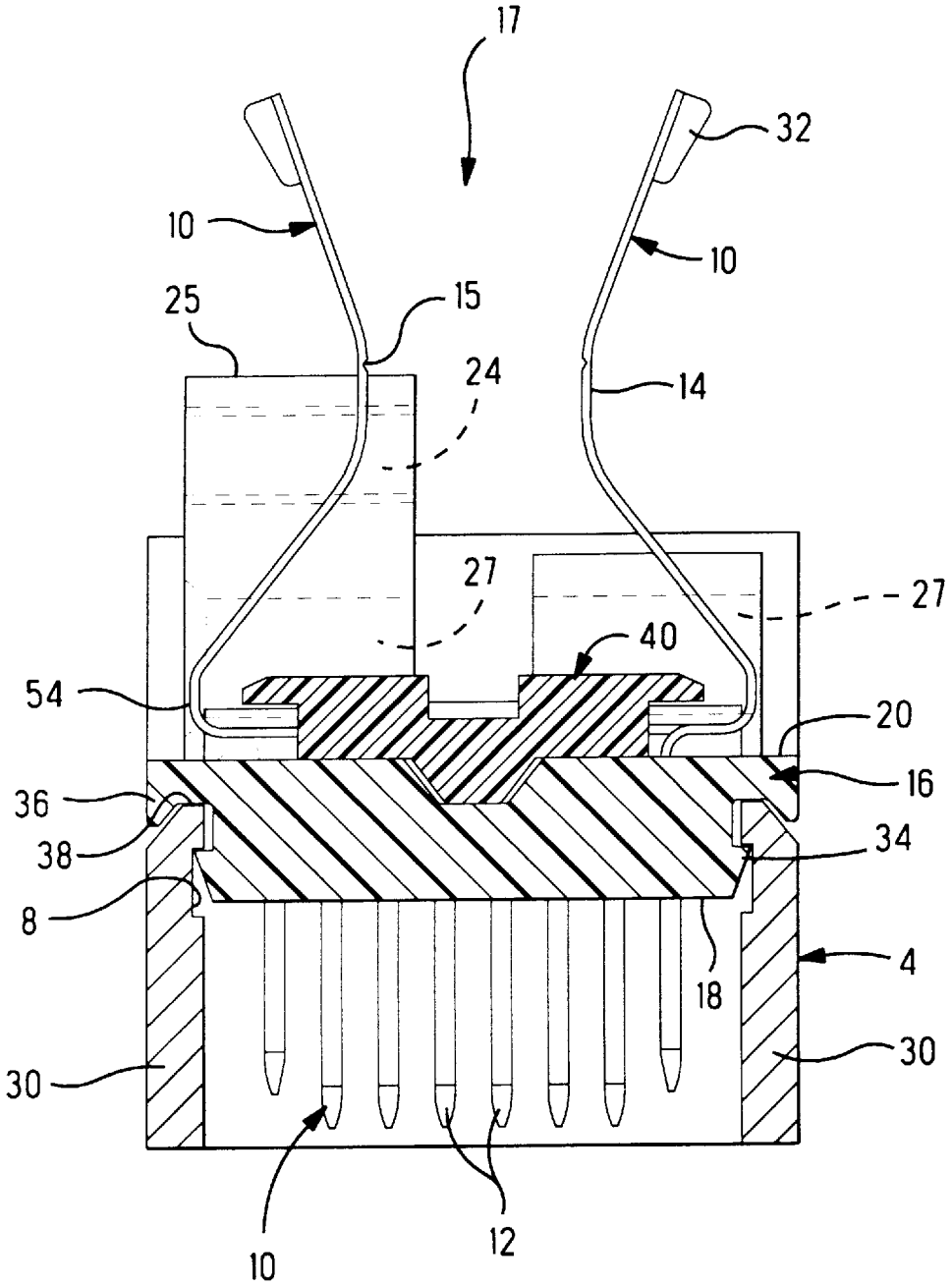
FIG. 8 shows a cross-sectional view of a module assembly inserted into a frame.

Referring now to FIG. 4, sides 21 and 23 have latches 34 and shoulders 36 which cooperate with groove 8 in the frame 4 (FIGS. 1 and 8). On the top surface 20, there are arcuate projections 22 which will be used as anvils and will be described more fully below. Comb projections 26 are disposed on the top surface 20 and extend from the center towards each side 23, 21. Cavities 60 pass straight through the base 16 and have a small ramped section 67 to urge the tail section 14 against the opposite wall as they are inserted for precise positioning. L-shaped cavities 61 have a ramped section 64 along which a portion of tails 14 extends from the fourth row on the bottom surface 18 to the third row on the top surface 20. Contact 10 insertion and bending will be described in greater detail below.

Figure 5:
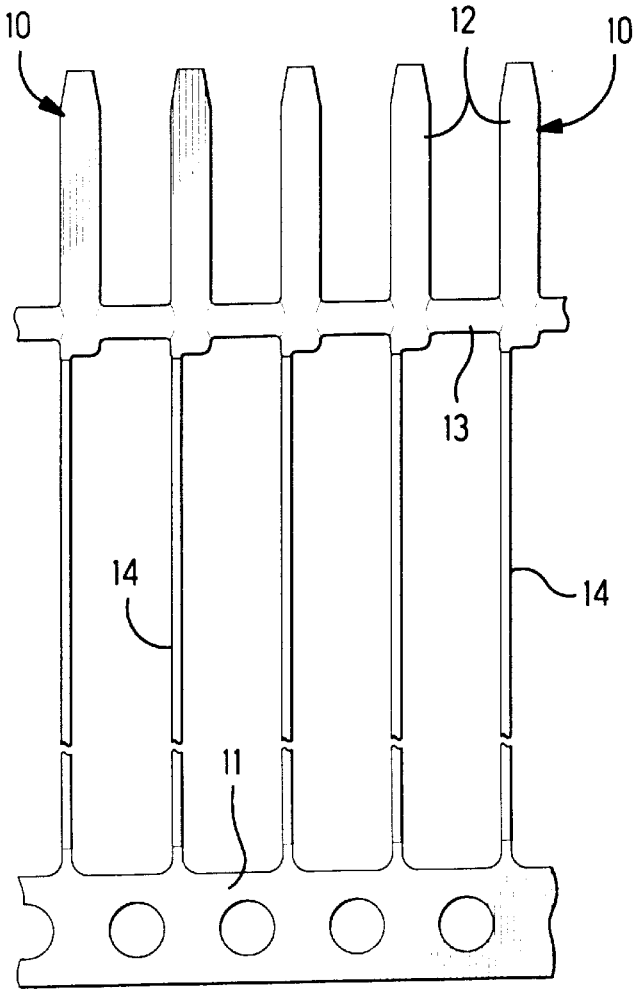
FIG. 5 shows a front view of the contacts on a carrier strip.
Figure 6:
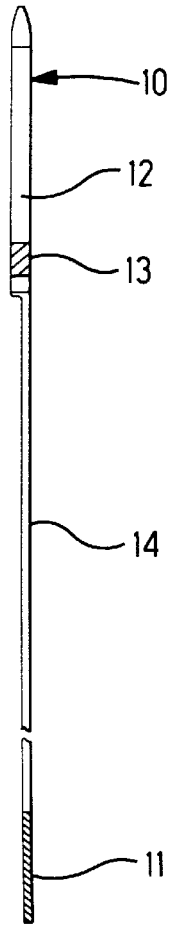
FIG. 6 shows an end view of the contacts of FIG. 5.

Contacts 10 will now be described in greater detail referring to FIGS. 5 and 6. Each contact 10 has a tail section 14 and a contact section 12. Contact sections near ends of tail section 14 are electrically connected to associated contact pads on the circuit board (not shown) and the contact section 12 are used to mate with corresponding contacts of the mother board connector (not shown). Contacts 10 are attached to a main carrier strip 11 at the outer ends of tail section 14 end and are attached to a second strip 13 at the transition between the tail section 14 and the contact section 12.

Figure 7:
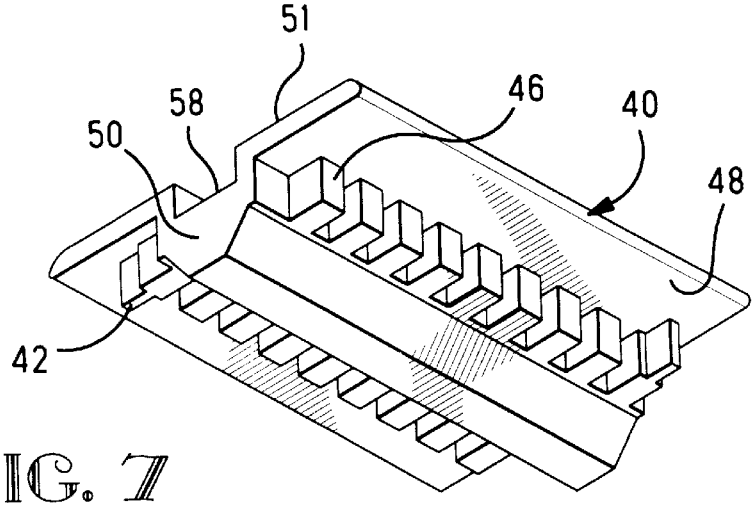
FIG. 7 shows an isometric view of the bottom face of the module cover.

Referring to FIG. 7, the cover or cover 40 will now be described in greater detail. The cover 40 is made from a suitable dielectric material and has a top surface 51 and a bottom surface 48. On the top surface 51, and 58 is formed to receive a portion of the circuit board edge (not shown). On the bottom surface 48 of the cover 40, a rib 50 extends along the length generally in the center of the cover 40 directly below the slot 58. The rib 50 cooperates with a rib receiving center section 28 (FIG. 9) in the base 16. Insulating projections 46 extend from the sides of the rib 50 outward towards each side edge of the cover 40. Extending from selected insulating projections 46 are positioning projections 42 which cooperate with grooves 44 (FIG. 9) on the top surface of the base 16.

The frame 4 shown in FIGS. 1 and 8 will now be described in greater detail. The frame 4 is made of a rigid conductive material, for example metal, and receives a plurality of modules 6 in grooves 8 that extend along the inner surfaces of walls 30 of the frame 4.

Assembly of the major components described above will now be described. The contacts 10 of FIG. 5 are first cut from the strip 11 in groups of five to correspond with the number of contacts in each row of the base 16 and then inserted into a hand held spring loaded clamping tool (not shown) with the contact section 12 being clampingly held in the clamping tool. The contacts 10 are then inserted into a press which removes both the main carrier strip 11 and the intercontact portions of second carrier strip 13. With five contacts still clamped in the tool to maintain contact spacing, contacts 10 are inserted into a base 16, with tail section 14 being inserted from the bottom surface or mating face 18. As shown in FIG. 2, after insertion, intermediate portions of the tail section 14 are first bent outward over arcuate projections 22 on the top surface or cover-receiving face 20 of the base 16. Eight rows of contacts are inserted from the bottom surface 18 in this manner and they exit the top surface 20 in six rows The six rows are bent outwardly to form two symmetrical arrays of very closely spaced tail section 14 as show in FIG. 9. These two arrays are then bent upwardly and inwardly forming two rows defining the board receiving opening 17 to engage opposite sides of a circuit board near its edge. The cover 40 may be placed on the base 16 either before or after upward and inward bending of the tail section 14. The contact insertion process will now be described in greater detail.

While it is desirable to maximize the number of rows that exit the bottom surface 18, contacts can not pass directly through base 16 into the center section 28 because that space is reserved on the top surface 20 for bonding to the cover 40. Therefore, in order to have rows of contact section 12 in the center of the bottom surface 18, contact tail section 14 entering the centermost fourth row from the bottom 18 must be shifted outward as they pass through the base 16 so that they exit the top surface 20 clear of the center section 28.

This is accomplished as shown in FIGS. 3–4 by varying the cavity shape for each row that passes through the base 16. The outer cavities 60 are shaped such that they pass straight through the base 16 and are arranged symmetrically about the center of the base 16. Viewing the base 16 of FIG. 3 from the bottom surface 18 and beginning with the outer most rows adjacent to sides 21 and 23, the first, second, and third rows of contact tail section 14 are inserted into cavities 60 straight through the base.

Figure 9:
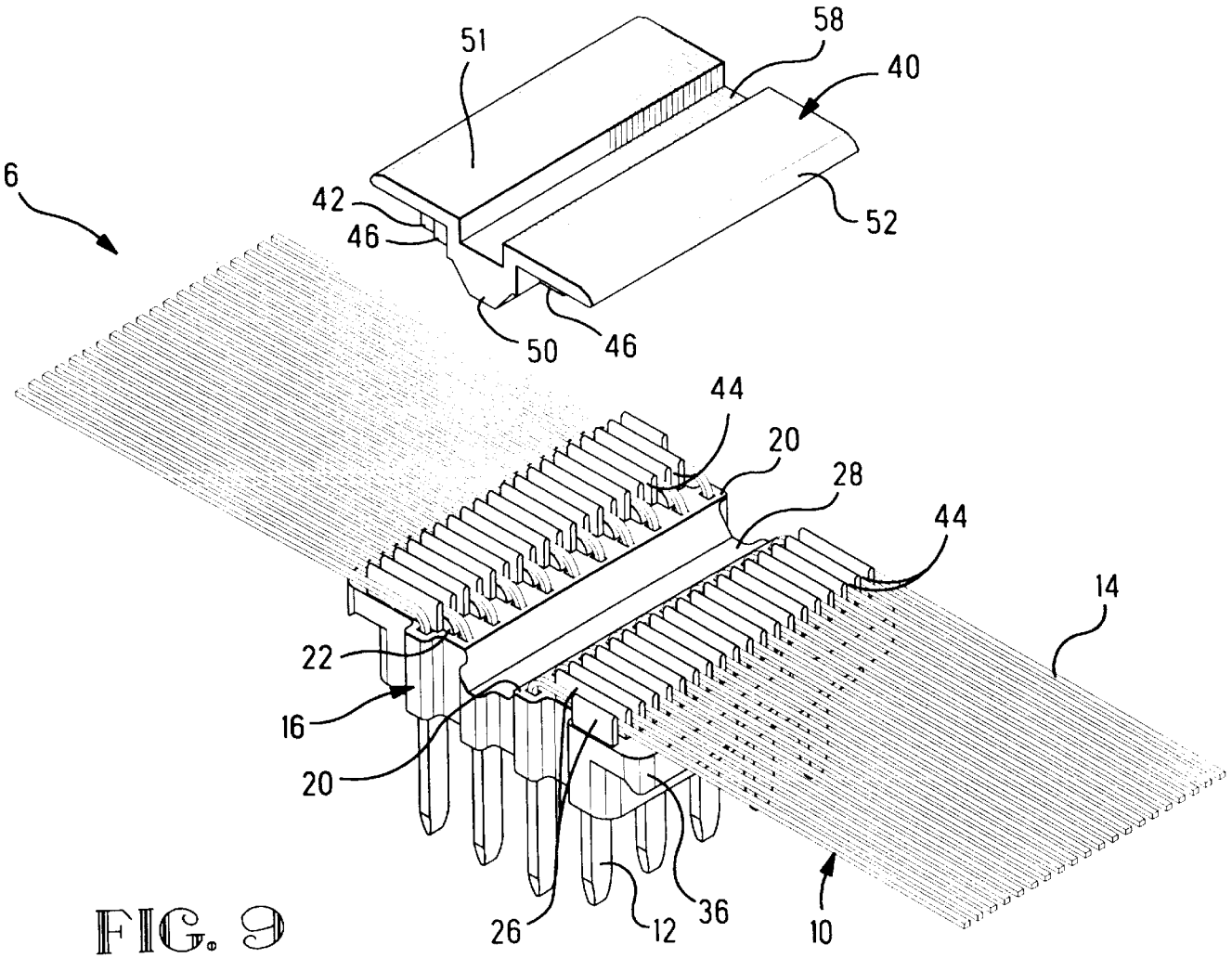
FIG. 9 shows an isometric view of a module base having the contacts inserted therein prior to final bending, with the cover thereabove poised for receipt in the base.
Figure 10:
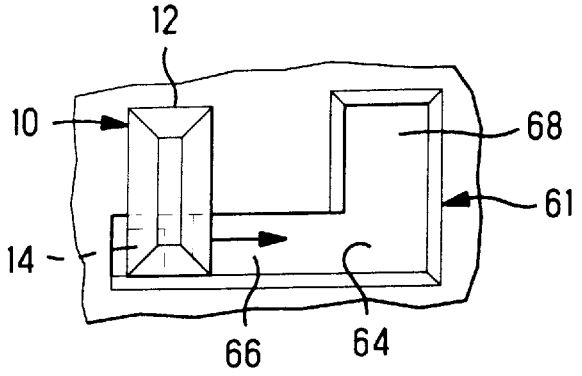
FIG. 10 shows a bottom view of an L-shaped cavity having a tail inserted in the initial position.
Figure 11:
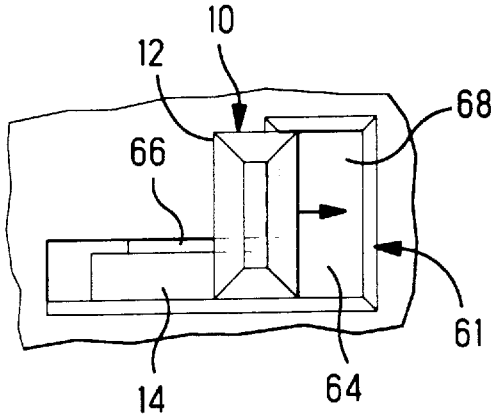
FIG. 11 shows a bottom view of an L-shaped cavity with a tail being urged down the long leg.
Figure 12:
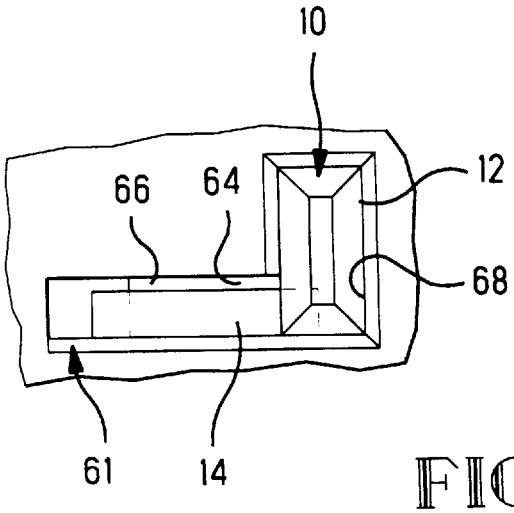
FIG. 12 shows a bottom view of an L-shaped cavity with a tail in its final position.

The fourth row of contact tail section 14 are inserted from the bottom surface 18 at the end of the long leg 66 as shown in FIG. 10. In this position the tail portion 14 passes straight through the base 16, but the contact section 12 abuts the bottom surface 18 of the base 16, since contact section 12 is wider than the corresponding cavity 61. The tail section 14 then cooperates with the ramped surface 64 as it is urged down the long leg 66. The contact section 12, initially at the end of long leg 66 remote from short leg 68, after abutment with bottom surface 18, are then urged down the long leg 66 of the L-shaped cavity 61 towards the center of the base 16 as shown in FIG. 11. The contact section 12 are finally pressed into their final position when aligned with the short leg 68 as shown in FIG. 12. The contact tail section 14 of the third and fourth rows therefore exit the top surface 20 in a common third row, leaving the center section 28 open for receiving the printed circuit board edge. At this point, six rows of tail section 14 of the contacts exit the top surface 20 before further bending. Further bending of the tail section 14 places them between the comb projections 26 form the six rows into two diverging coplanar arrays of tails as shown in FIG. 9. The comb projections 26 insulate the tail section 14 from each other and ensure that proper spacing is maintained in the tail section 14 near the base 16. Tail section 14 preferably have been scored at notches 15 (FIG. 2) so that their outer ends may be broken away after final soldering to the circuit board. Tail spacing is preferably maintained at the tips by an adhesive bead 32, shown in FIG. 8, which is spread over all of the tail outer ends and then is hardened.

As shown in FIG. 9, after the six rows exiting the top surface 20 are first bent outward to form two diverging coplanar arrays, the cover or cover 40 of FIG. 7 is then placed over the base 16. Positioning projections 42 cooperate with grooves 44 in the base 16 to properly position the cover 40 over the base 16 in the longitudinal direction. The positioning projections 42 also limit motion of the cover 40 with respect to the base 16. Each cover 40 however, is slidable to a limited extent in the lateral direction as indicated by the gap shown between the cover 40 and the base 16 in the center section 28 shown in FIG. 8. This movement is provided in order to align slots 58 with those of adjacent covers 40 during final assembly of the connector 2.

The cover 40 of FIG. 7 also has insulating projections 46 on its bottom side 48. The insulating projections 46 fit between the tail section 14 on the innermost top row at the first outward bend location over the base 16 as best seen in FIG. 9, and serve as both insulators and spacers. The rib 50 on the bottom surface 48 of the cover 40 fits into the center section 28 of the base 16 and a curable adhesive is applied to the base 16 but is not yet cured at this point. Other suitable bonding techniques may be used such as ultrasonic bonding. The rib 50 provides more bonding surface area in the transverse direction. Thus in connector applications subjected to high shear stresses, the rib 50 is preferred.

Final assembly of the modules to the frame to form the connector 2 will now be described. Referring again to FIGS. 1 and 2, the base 16 of each module 6 is secured to the frame 4 using a latch 34 and a shoulder 36 as shown in FIG. 5. Upward movement is prevented by cooperation of the latch 34 on the side of the base 16 with a groove 8 in the side 30 of the frame 4. Any additional downward movement is prevented by cooperation of the shoulder 36 with the top surface 38 of the frame 4. An adhesive (not shown) may be applied to the top surface 38 of the frame 4 to permanently secure the base 16 of the module 6 to the frame 4. The covers 40 are then aligned using a fixture (not shown) that has a rigid edge dimensioned similar to a circuit board edge which is placed in the slot 58 of each cover. The slots 58 are therefore aligned with each other to form a continuous board receiving slot. The bonding agent between the covers 40 and the bases 16 is then cured. A circuit board is then inserted into a circuit board receiving region 17 and is fastened to the assembly 2 with bolts or screws which are received by threaded holes 24 in maintaining flanges 25. Threaded holes 27 receive screws or bolts that hold a shield member (not shown) around the entire assembly 2.

Figure 13:
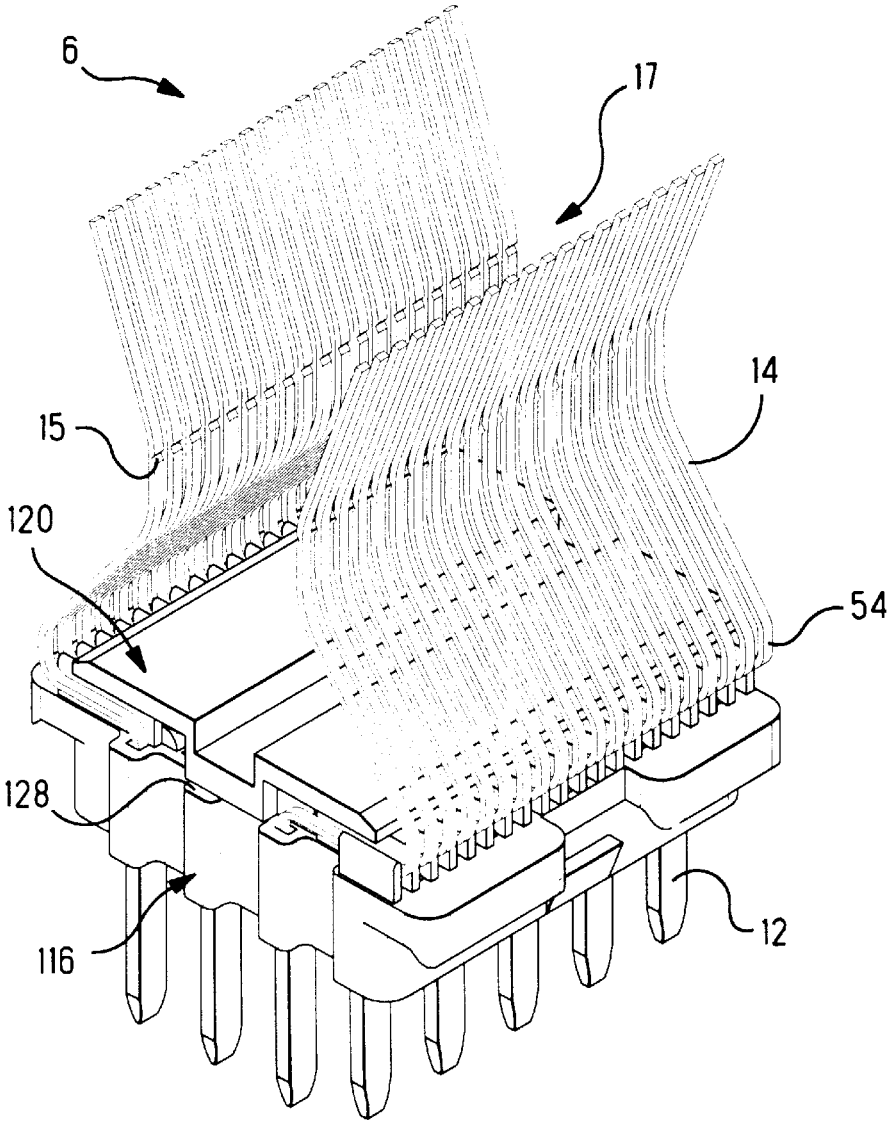
FIG. 13 shows an isometric view of an assembled alternate module having a simplified design for the cover.
Figure 14:
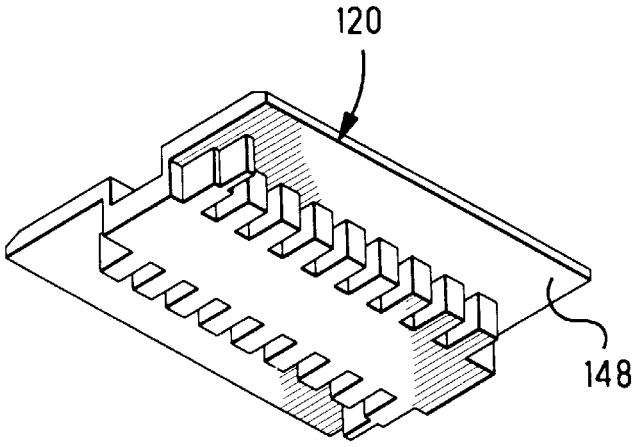
FIG. 14 shows an isometric view of the cover of FIG. 13.

A simpler design, shown in the alternate embodiment of FIGS. 13 and 14 may be used in applications where shear stresses are not a concern. The simplified design does not include a rib along the bottom surface of the cover 120 and the base 116 does not have a rib receiving groove. The bottom surface 148 of the cover 120 is aligned and bonded to the center section 128 of the base as described above.

Figure 15:
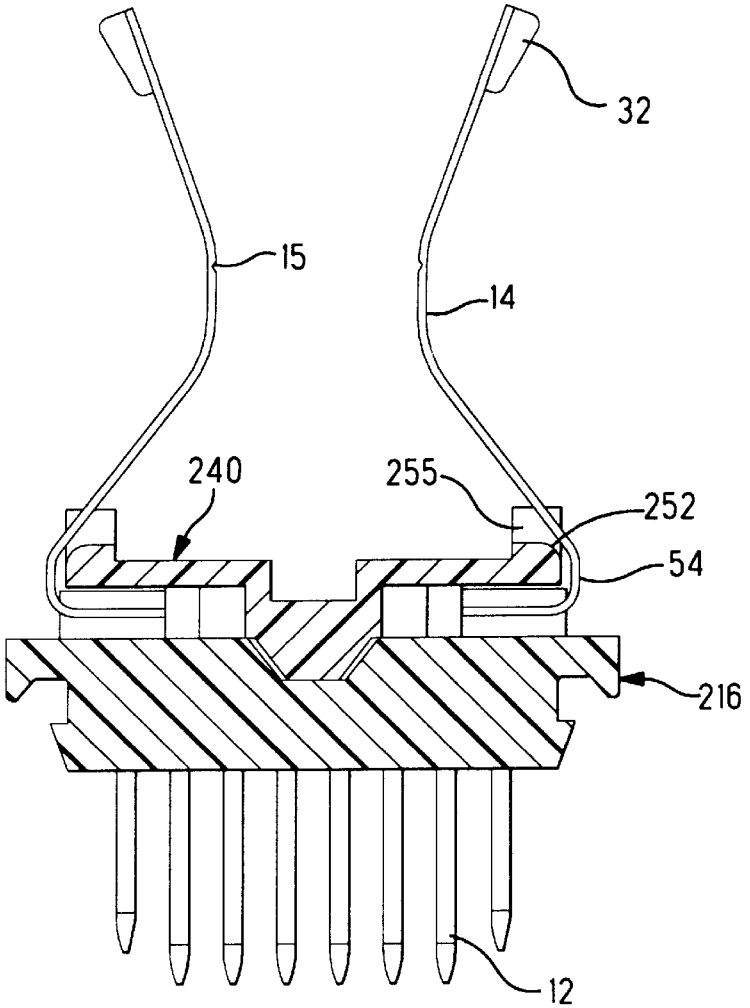
FIG. 15 shows a cross-sectional view of an alternative embodiment of a base and cover module having alignment projections on the top surface of the cover.
Figure 16:
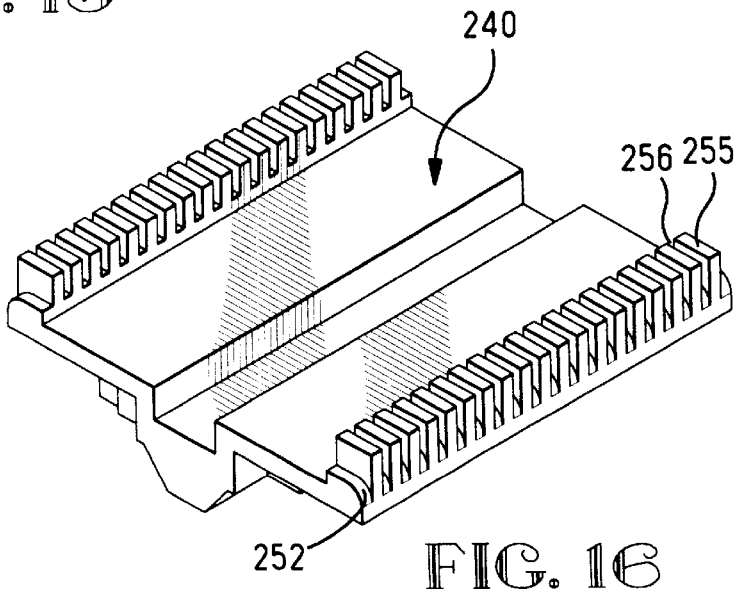
FIG. 16 shows an isometric view of the cover shown in FIG. 15.

Referring now to FIGS. 15 and 16, another embodiment of a cover 240 of this invention is shown with base 216. Here, arcuate cover edges 252 are located for engagement with tail section 14 at the second bend 54. The tail section 14 can therefore be bent around the arcuate cover edges 252. Without this feature an anvil must be used to bend the contacts with appropriate care. This feature thus eliminates the need for additional anvil tooling. Additionally, spacing barrier walls 255 between anvils 256 are formed on the arcuate cover edges 252. These barrier walls 256 serve to maintain proper contact spacing and provide additional insulation between adjacent tail section 14.

Figure 17:
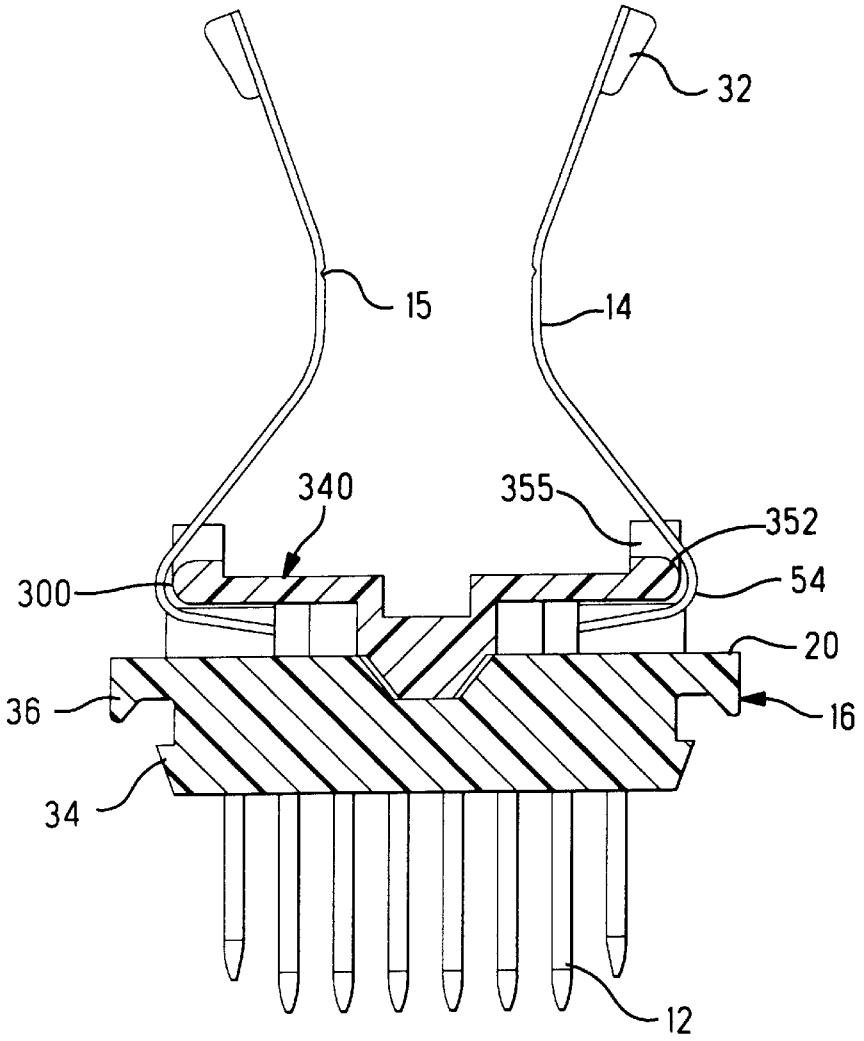
FIG. 17 shows a cross-sectional view of an alternative embodiment of a module having anvil surfaces on the bottom surface of the cover.
Figure 18:
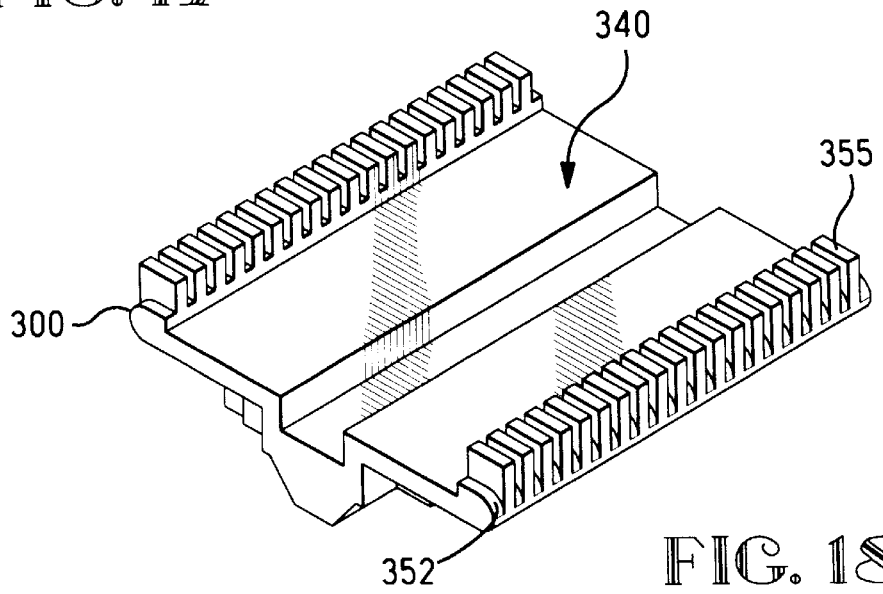
FIG. 18 shows an isometric view of the cover shown in FIG. 17.

Turning now to FIGS. 17 and 18, another embodiment of the cover 340 of this invention is shown usable with base 16 of FIGS. 1–9. The cover has two arcuate surfaces 352, 300 which are engaged by the contact tails to provide a second bend. Tail section 14 can then be bent around the arcuate cover edges 300 and 352. No further anvil tooling is required to perform the first and second bends. Optional spacing barrier walls 355 may also be added to this embodiment. As in earlier embodiments, these barrier walls 355 provide insulation and maintain proper contact spacing between adjacent tail section 14.

Figure 19:
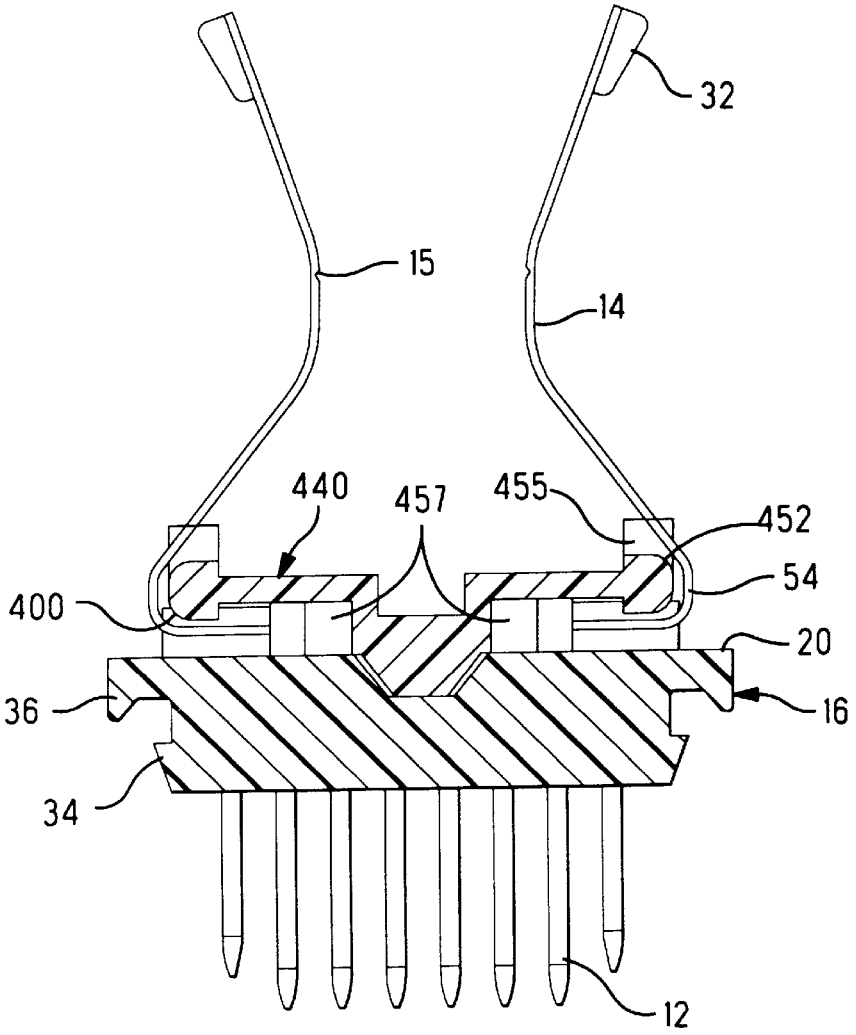
FIG. 19 shows a cross-sectional view of a further alternative embodiment of a module having alignment projections and anvil surfaces on the bottom surface of the cover.
Figure 20:
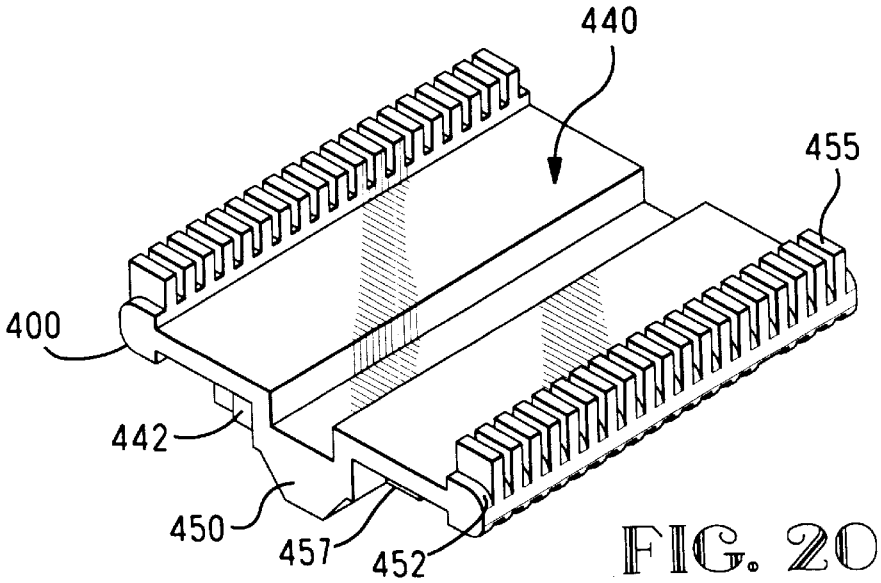
FIG. 20 shows an isometric view of the cover shown in FIG. 19.

Referring now to FIGS. 19 and 20, another embodiment of the cover 440 of this invention is shown with a base 16. This embodiment incorporates the arcuate surfaces 452 of the previous embodiment and additionally as extended anvil surfaces 454 on the bottom surface of the cover to maintain contact tail section 14 in a horizontal position between the comb projections of the base. Optional upper and lower spacing barrier walls 455 and 457 may also be added to this embodiment. The spacing barrier walls 455 on the top surface of the cover maintain proper contact tail spacing between adjacent contacts on the top, and bottom walls 457 similarly on the bottom cover surface. The anvil surfaces 454 extending on the bottom surface of the cover provide with an anvil surface and maintain the contacts in a horizontal orientation along the top surface 20 of the base. This embodiment therefore provides the features of having proper contact spacing using barrier walls 455 and also provides the feature of complete anvil surfaces for the second and third bends of the contact tail section 14. It also maintains the contact tails horizontal and locked against the top surface of the base 20.

The advantage of these embodiments is that a module is supplied without a potting layer over the contact tail section 14. Insulation between adjacent tail section 14 is nevertheless maintained and the overall connector height is reduced. Additional organizing members are not necessary as the cover 40 is also designed to maintain proper tail spacing both between the cover 40 and the base 16 and also between the top of the cover 40 and the board receiving opening 17.

It is evident that any of the features shown in the alternate embodiments could be combined in many ways to incorporate the desired features for various cations of the connector.

We claim:

1. A high density electrical connector module comprising:

a base having contact receiving passageways extending from a bottom surface to a top surface thereof and disposed in a plurality of rows;

a plurality of contacts passing through said contact receiving passageways, each exposed for electrical connection having a terminal portion along said bottom base surface and intermediate and contact portions extending from said top base surface;

a cover disposed directly on said top base surface over said intermediate and contact portions, said cover having insulating members along a bottom surface thereof which cooperate with said base to insulate said intermediate portions of adjacent ones of said contacts from each other to direct said contact portions around a periphery of said cover.

2. The high density electrical connector module as recited in claim 1 wherein said cover further comprises locating means cooperable with complementary locating means of said base whereby said cover is properly positioned atop said base so as to maintain proper contact spacing.

3. The high density electrical connector module as recited in claim 1 wherein said cover further comprises a rib along said bottom surface, said rib having two opposed angled surfaces which cooperate with a complementarily angled sidewalls of a groove in said base top surface.

4. The high density electrical connector module as recited in claim 1 wherein said cover further comprises a slot on a top surface of said cover, said slot receives an edge of a printed circuit board being perpendicularly oriented with respect to said top surface of said cover.

5. The high density connector module as recited in claim 1 wherein said base comprises a mating face opposite said top surface, said top surface having a cover receiving face disposed thereon, and said contact receiving passageways extending from said mating face through said base to said cover receiving face, said contact receiving passageways being arranged in a smaller number of rows on said cover receiving face than on said mating face.

6. The high density electrical connector module as recited in claim 1, wherein a plurality of said modules are assembled in a common frame, said covers of said modules being adjustable over said bases to align slots in said covers with each other whereby a continuous slot is formed in the resulting electrical connector to receive an edge of a circuit board.

7. The high density electrical connector module as recited in claim 1 wherein said cover further comprises arcuate surfaces disposed on opposed side edges being engageable at least during assembly with said intermediate portions of said contacts whereby said contact portions are bendable over said arcuate surfaces.

8. The high density electrical connector module as recited in claim 7 wherein said cover further comprises insulating projections extending from a top surface thereof at least adjacent said opposed side edges of said cover forming discrete slots therebetween to receive said intermediate portions of said contacts.

9. The high density electrical connector module as recited in claim 7 wherein said cover further comprises protrusions extending from said arcuate surfaces isolating said contacts in discrete slots formed between said protrusions.

10. The high density electrical connector module as recited in claim 7 wherein said cover further comprises arcuate projections extending from said bottom cover surface and cooperating with comb projections along said top base surface to contain said intermediate portions of said contacts.

11. The high density electrical connector module as recited in claim 10 wherein said cover further comprises insulating projections extending from said top surface adjacent said opposed side edges of said cover forming discrete slots therebetween to receive said intermediate portions of said contacts.

12. A high density electrical connector module comprising:

a base having contact receiving passageways extending from a bottom surface to a top surface thereof and disposed in a plurality of rows;

a plurality of contacts passing through said contact receiving passageways, each exposed for electrical connection having a terminal portion along said bottom base surface and intermediate and contact portions extending from said top base surface;

a cover disposed on said top base surface over said intermediate and contact portions, said cover having insulating members along a bottom surface thereof which cooperate with said base to insulate said intermediate portions of adjacent ones of said contacts from each other;

wherein said base further comprises anvil surfaces disposed on a cover receiving face of said base adjacent to and corresponding with an inner row of contact receiving passageways exiting the cover receiving face, whereby intermediate portions of said contacts exit said passageways on said cover receiving face and are bent outwardly over said anvil surfaces along said cover receiving face.

* * * * *